United States Patent [19]

Desanta

[11] Patent Number: 4,792,187

[45] Date of Patent: Dec. 20, 1988

[54] PIVOT MECHANISM FOR SEATS

[76] Inventor: Simon Desanta, Hollen im Lohden, D-8430 Gutersloh 12, Fed. Rep. of Germany

[21] Appl. No.: 74,701

[22] Filed: Jul. 16, 1987

[51] Int. Cl.[4] ..... A47C 3/00

[52] U.S. Cl. ..... 297/300; 297/302; 297/304; 297/320

[58] Field of Search ..... 297/300, 301, 302, 304, 297/320, 325, 316

[56] References Cited

U.S. PATENT DOCUMENTS

| | | | |
|---|---|---|---|
| 2,296,603 | 9/1942 | Feldman | 297/320 X |
| 2,619,153 | 11/1952 | Van Osselen | 297/302 |
| 4,479,679 | 10/1984 | Fries et al. | 297/300 |
| 4,653,806 | 3/1987 | Willi | 297/300 |

FOREIGN PATENT DOCUMENTS

| | | | |
|---|---|---|---|
| 869337 | 4/1971 | Canada | 297/304 |
| 2040429 | 2/1972 | Fed. Rep. of Germany | 297/300 |
| 3322450 | 1/1985 | Fed. Rep. of Germany | 297/300 |
| 8607194.7 | 6/1986 | Fed. Rep. of Germany | . |
| 958120 | 12/1947 | France | 297/302 |

*Primary Examiner*—Kenneth J. Dorner
*Assistant Examiner*—Laurie K. Cranmer
*Attorney, Agent, or Firm*—Young & Thompson

[57] ABSTRACT

The pivot mechanism is intended for height-adjustable seats, especially office chairs or office armchairs, with a seat (6) and a back 7) arranged at an underframe (8) to be pivotable in synchronism and being under the effect of a pretensionable pullback spring against the tilting motion oriented rearwardly, as well as with a device for locking the back (7) in positions of varying tilt. The pivot mechanism is characterized in that the seat (6) exhibits spring elements (11) effective in the pivoting plane of the back (7), which spring elements are attached to the underframe (8) and to the back (7) and act on the back (7) as pullback springs tensionable by the user's weight.

3 Claims, 1 Drawing Sheet

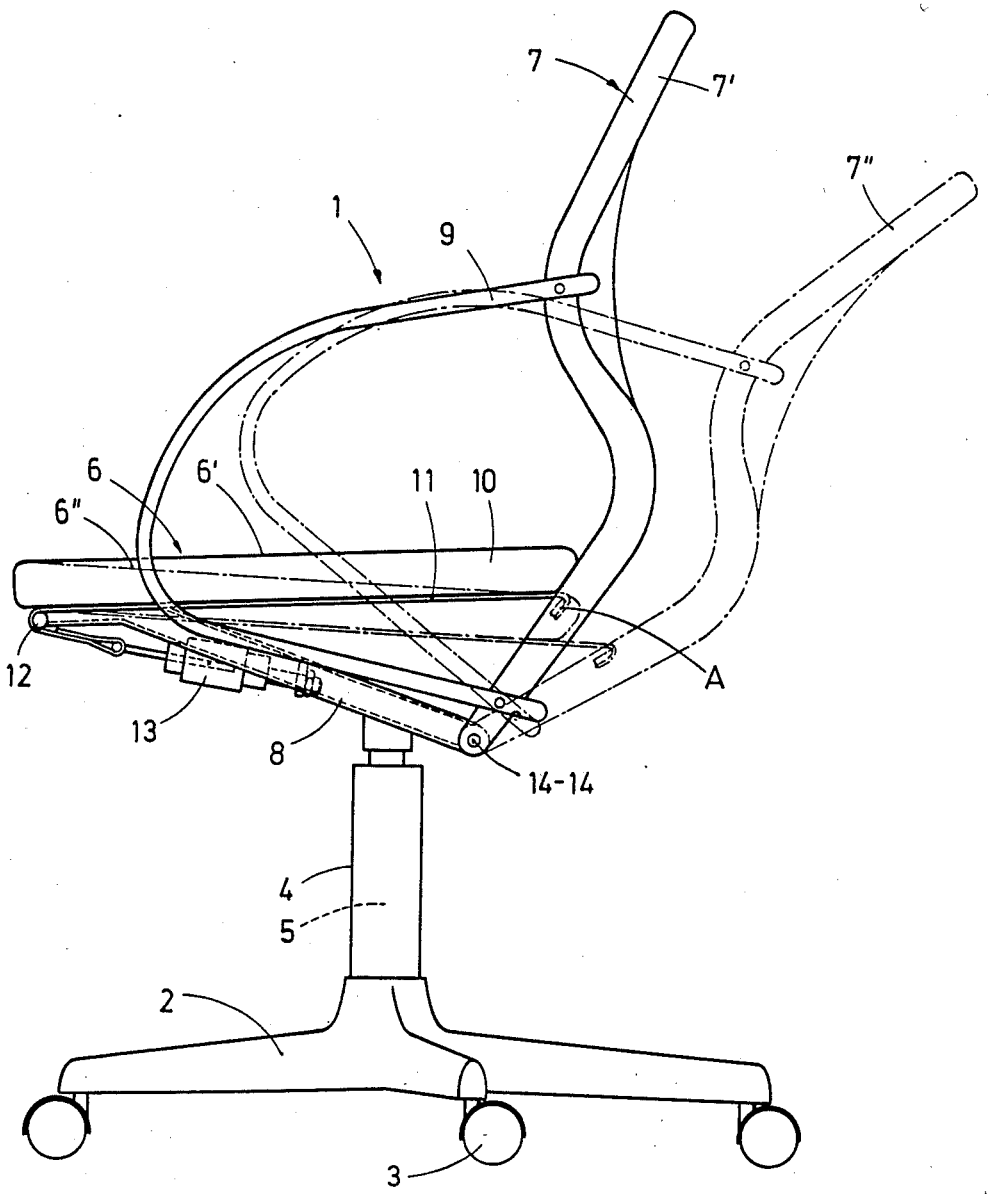
7
7'
7"
1
9
6
6'
6"
11
10
12
13
8
A
14-14
4
5
2
3

PIVOT MECHANISM FOR SEATS

The invention relates to a pivot mechanism for height-adjustable seats.

In the conventional pivot mechanisms for chairs and armchairs, the pullback springs utilized are mechanical, hydraulic and pneumatic springs of varying designs. The pullback springs are installed with pretensioning; the spring characteristic and thus the resetting force acting on the back of the sitting furniture when a person seated on the latter leans back and leans forward can be varied in dependence on the adjustable pretensioning of the pullback springs. Such tilt mechanisms known, for example, from German Utility Model No. 84 17 429 are very complicated in their technological aspects and require a relatively large volume of space for installation below the seat, whereby the appearance of the chair is impaired.

The invention is based on the object of developing a pivot mechanism for seats which is distinguished over the conventional pivot mechanisms by a substantially simpler structure and a less expensive manufacturing cost.

This object has been attained according to the invention by the features set forth below.

The invention is distinguished in that it solves the posed problem in a simple and expedient fashion.

The invention and its additional advantages will be described in detail below with reference to a swivel armchair shown in the accompanying drawing in a lateral view.

The swivel armchair (1) exhibits a base (2) equipped with casters (3), this base carrying the base tube (4) with a gas-pressure spring (5) installed therein for the height adjustment of the seat (6) and the back (7) which latter (6, 7) are mounted to the underframe (8) to be pivotable in synchronism. Two armrests (9) are articulated to the back (7). The seat (6) has a seat pad (10) resting on spring elements (11), which latter constitute an essential functional part of the pivot mechanism of the swivel armchair (1).

The spring elements (11), designed as tension springs and consisting, for example, of coil springs or spring belts, and serving simultaneously to support the seating surface, are attached, on the one hand, by way of a guide roller (12) arranged at the front end of the underframe (8) and by way of a tensioning element (13) designed as a turnbuckle, to the underframe (8) and, on the other hand, at (A) to the back (7) above the pivot axle (14—14) of the latter, arranged in the underframe (8).

In case the user of the swivel armchair (1) assumes an upright sitting position, the back (7) is maintained in the vertical or almost vertical position (7') by the spring force provided by the pretensioned spring elements (11), and the seat (6) assumes the almost horizontal position (6'). The pretensioning of the spring elements (11) can be adjusted by the tensioning element (13) designed as a turnbuckle.

In case the user of the swivel armchair (1) leans backwards into a relaxed position, the back (7) pivots under the body weight against the pullback force of the spring elements (11) about the pivot axle (14—14) arranged in the underframe (8) rearwardly into the tilted position (7''), and the seat (6) is pivoted in synchronism with the pivoting motion of the back (7) about the guide roller (12) mounted to the front end of the underframe (8) downwardly into position (6'').

When the user rises from the relaxed attitude to the upright sitting position, the back (7) and the seat (6) return from positions (7'', 6'') again to positions (7', 6') under the effect of the pullback force provided by the spring elements (11).

The mode of operation of the pivot mechanism, wherein the magnitude of the pullback force acting on the back (7) is primarily determined by the user's weight and only secondarily by the tensioning element (13), has the advantage that the pullback force is set automatically in correspondence with the weight of the respective user so that the user can lean back into a relaxed attitude with little effort and, upon a forward leaning of the user into the upright sitting position, the back follows the movement of the user with a delay so that no unpleasant pressure forces are exerted on the user's back by the back of the chair.

The swivel armchair is suitably equipped with a device, not shown, for locking the back in the various tilt positions.

I claim:

1. In pivot mechanism for height-adjustable seats having a seat and a back attached to an underframe, the back being pivotally mounted to the underframe for forward and rearward swinging movement about a horizontal axis, and tension spring means yieldably resisting said rearward movement; the improvement in which said spring means extend and act between a forward end of the underframe and said back and are secured to said back above said horizontal axis, and a seat resting on and supported by said spring means, said spring means and seat being swingable downwardly about said forward end of the underframe upon rearward swinging movement of said back about said axis.

2. Apparatus as claimed in claim 1, said spring means extending about a horizontal guide member at the forward end of the underframe and being connected to a tensioning element for pretensioning said spring means.

3. Apparatus as claimed in claim 2, said spring means and said seat swinging vertically about said guide member as a pivot.

* * * * *